United States Patent [19]

Boser

[11] Patent Number: 4,813,364

[45] Date of Patent: Mar. 21, 1989

[54] BELT DRIVE MATERIAL FEED CONTROL APPARATUS FOR SEWING MACHINES

[76] Inventor: Ronald J. Boser, 215 N. Fehrway, Bayshore, N.Y. 11706

[21] Appl. No.: 179,074

[22] Filed: Apr. 8, 1988

[51] Int. Cl.[4] ..... D05B 35/10; D05B 3/04; D05B 27/10

[52] U.S. Cl. ..... 112/304; 112/153; 112/308

[58] Field of Search ..... 112/308, 304, 153, 121.12, 112/311, 318, 121.15, 320, 262.3

[56] References Cited

U.S. PATENT DOCUMENTS

| | | | |
|---|---|---|---|
| 2,290,123 | 7/1942 | Wilfong | 112/153 |
| 3,417,718 | 12/1968 | Anderson | 112/153 |
| 4,226,197 | 10/1980 | Pollmeier | 112/308 X |
| 4,423,690 | 1/1984 | Willenbacher et al. | 112/153 X |
| 4,493,277 | 1/1985 | Sanvito | 112/304 X |
| 4,498,407 | 2/1985 | Landwehr et al. | 112/308 |

*Primary Examiner*—Andrew M. Falik
*Attorney, Agent, or Firm*—Myron Amer

[57] ABSTRACT

For use with a sewing machine an attachment for guiding fabric in which use is made of a belt laterally displaced to the side of the feed dogs which is in contact with the fabric, and thus does not require to be descended thereagainst, and which also is oriented in the direction of sewing, wherein the speed at which the belt urges the fabric through the sewing station is controlled to be either slower or faster than the speed at which the fabric is urged through movement by the feed dogs, so that the relative difference between the speeds shifts the fabric in opposite directions laterally of the direction of sewing to thereby enable the sewing of varying curvatures in the edge of the fabric.

3 Claims, 2 Drawing Sheets

FIG.1
PRIOR
ART
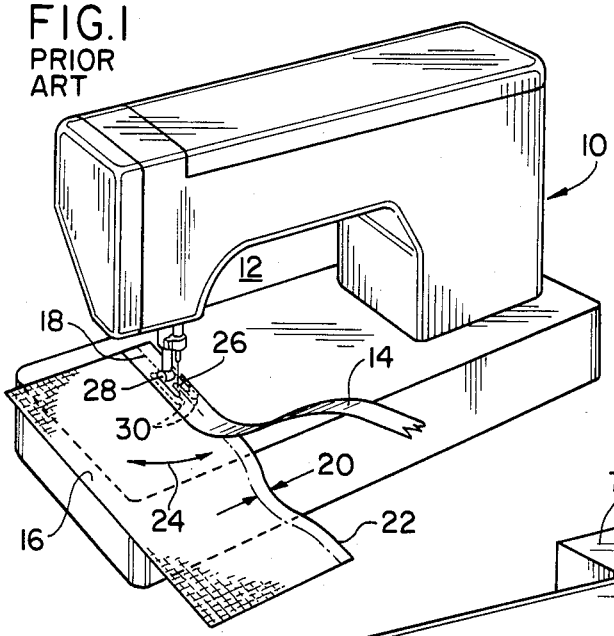
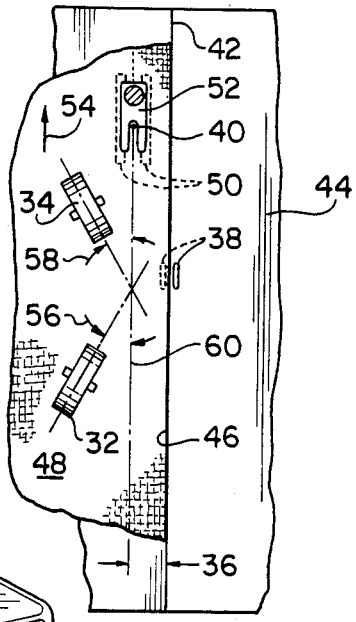
FIG.2
PRIOR
ART
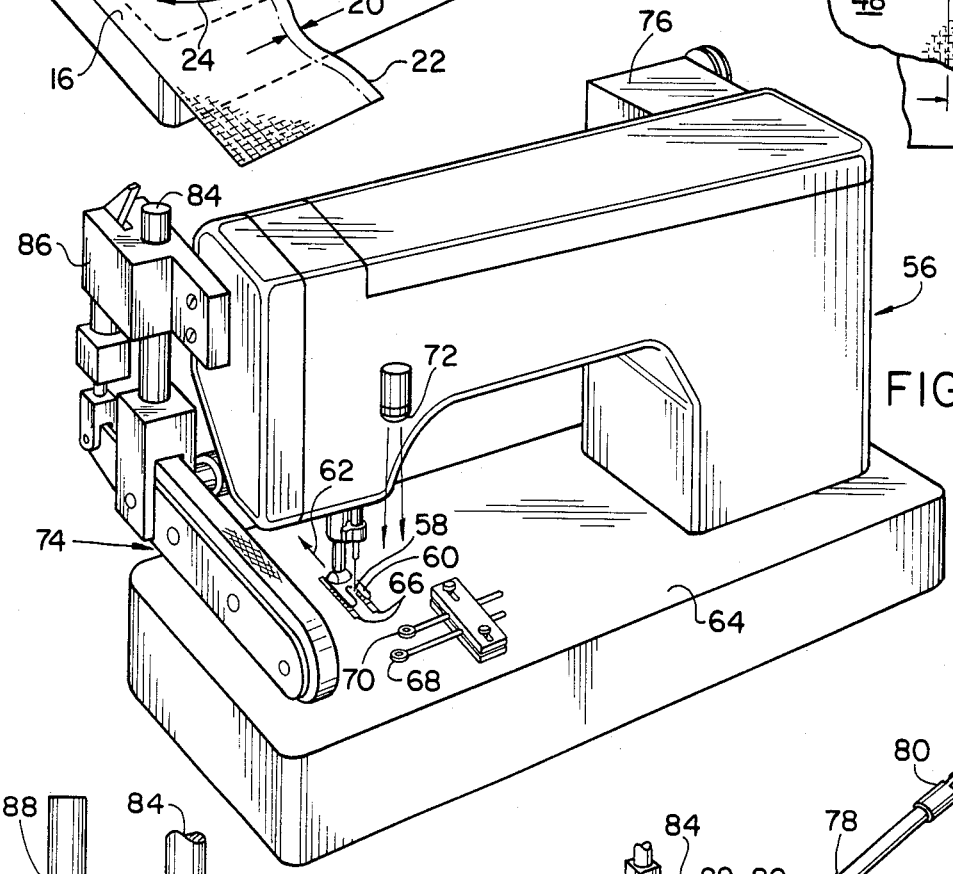
FIG.3
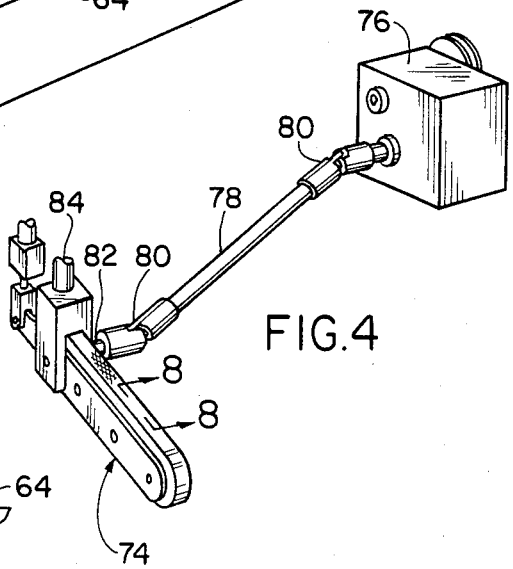
FIG.4
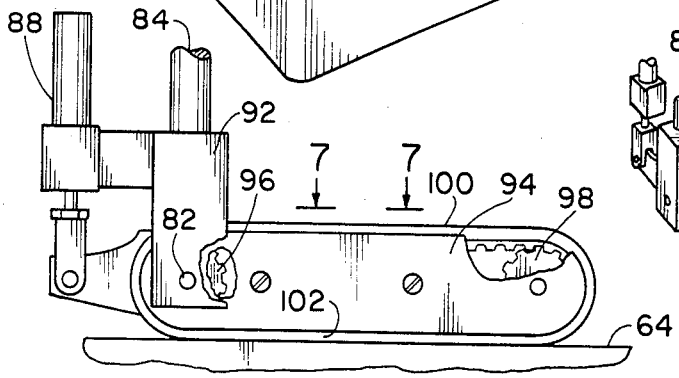
FIG.5

BELT DRIVE MATERIAL FEED CONTROL APPARATUS FOR SEWING MACHINES

The present invention relates generally to the finishing of a fabric edge, by either applying a tape or merely stitching down a fold therealong, and more particularly, to achieving this finished appearance in the fabric edge despite it having curvature which, of course, must be adjusted for during the sewing operation.

DESCRIPTION OF THE RELATED ART

The most popular sewing machine attachments for facilitating the sewing of a seam of uniform width along an irregular fabric edge are those using fabric-shifting rollers working in conjunction with photo cells. When strategically located photo cells are covered or uncovered by the fabric, depending on the curvature of its irregular edge, an appropriate electrical signal is generated to operate an appropriate roller from a clearance position into descending movement making contact against the fabric and then in rotation to urge the fabric through a correcting movement.

In U.S. Pat. No. 3,417,718 issued to Andersson on Dec. 24, 1968, rollers 20 and 22 are set at appropriate angles to the direction of sewing to shift the fabric being sewn either left or right in response to photo cell signals which monitor the curvature of any irregular fabric edge entering the sewing station. The angle in the rollers is, according to this patent, necessary to produce the fabric shift relative to the sewing direction, and being at an angle to the sewing direction, these rollers necessarily cannot be in contact with the fabric except when causing the fabric to shift. The fabric-positioning control of this patent, and of all other known prior art controls, contemplates movement of the one or more rollers from a clearance position into contact with the fabric being sewn incident to the use thereof.

In U.S. Pat. No. 2,290,123 issued to Wilfong on July 14, 1942, the fabric-positioner similarly descends, when needed, into contact with the fabric, but this positioner is noted because it is a belt, as is that of the within inventive positioner, and not a roller as is the case in the Anderson patent.

In sewing machine fabric positioning devices for assisting the seamstress in finishing an irregular fabric edge as just generally described, it is desirable to have as simplified an operational mode as possible, including obviating the alternate descending and ascending movement of fabric engaging rollers or belts which may be a movement occuring frequently during the sewing, if the fabric edge is particularly varying in its shape.

SUMMARY OF THE INVENTION

The object of the present invention is to provide a fabric positioning device in the general classification discussed, in which the fabric engaging component, preferably in the form of a belt, is one in which the raising and lowering thereof is not necessary, and the construction and operation thereof is correspondingly greatly simplified.

The within inventive fabric-positioning belt is, except when the fabric is loaded beneath it or removed from under it, in contact with the fabric being sewn because it is oriented in the direction of sewing and, thus, does not hinder the sewing. Nevertheless, it effectively shifts the fabric either to the left or right of its sewing direction orientation, by an adjustment of its speed relative to the operating speed of the feed dogs. As will be better understood from the detailed description which follows, the belt, relative to the feed dogs, exerts either a "drag" or a "pull" on the fabric being sewn, and in this way causes the necessary directional shift in the fabric entering the sewing station to adjust for the irregularity of the fabric edge.

The description of the invention which follows, together with the accompanying drawings should not be construed as limiting the invention to the example shown and described, because those skilled in the art to which this invention appertains will be able to devise other forms thereof within the ambit of the appended claims.

BRIEF DESCRIPTION OF THE DRAWINGS

FIG. 1 is a perspective view of a typical prior art sewing machine illustrating a fabric panel in the process of having attached to it a hem strip along an irregular edge of the fabric panel;

FIG. 2 is also of the prior art, specifically of prior U.S. Pat. No. 3,417,718, illustrating in plan view the sewing machine and fabric edge guiding device for practicing the sewing operation of FIG. 1;

FIG. 3 is a view similar to FIG. 1, on an enlarged scale, and illustrating a sewing machine to which the inventive fabric edge guiding device has been applied;

FIG. 4 is an isolated perspective view of the inventive fabric edge guiding device;

FIGS. 5 and 6 are respectively right and left, side elevational views of the FIG. 4 device, FIG. 5 having parts broken away to better illustrate structural features and illustrating the FIG. 4 device in sewing operation, and FIG. 6 illustrating said FIG. 4 device in its fabric receiving and releasing condition;

DESCRIPTION OF THE PREFERRED EMBODIMENT

Figure 6:
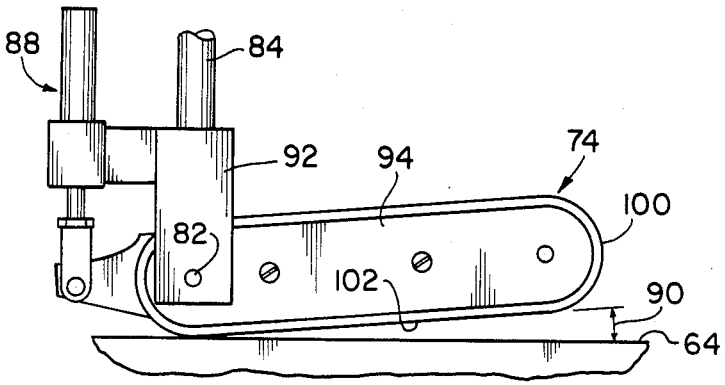

Referring to FIG. 1 of the drawings, reference numeral 10 denotes a typical "prior art" sewing machine in common use. Within the throat 12 of the machine 10 a hem strip 14 is being sewn to a fabric 16. During the course of the operation, it is important that the seamstress skillfully maintain the stitching 18 at a constant distance 20 from the fabric edge 22 to insure a good seam. When edge 22 is irregular, that is, it curves to the left or right, of a line extending straight and rearwardly of sewing position 26, the seamstress must maneuver the fabric 16 laterally (see arrow 24) about sewing position 26 as it is fed under presser foot 28 by feed dogs 30, to maintain distance 20.

In FIG. 2, which is another example of "prior art" and specifically related to the problem of controlling seam width, is shown follower type guide rollers 32, 34 which are alternately used to maintain edge distance 36 constant. Sensing means 38 (electrical or mechanical) strategically are located just in front of sewing position 40 and in straddling relation to reference line 42, and are used to monitoring the position of edge 46 of fabric 48. During the sewing operation, feed dogs 50 cooperate intermittently with presser foot 52 in a known and understood manner to advance fabric 48 in the conventional direction of sewing denoted by the arrow 54.

In accordance with the FIG. 2 prior art set up, when edge 46 of fabric 48 begins to drift outside the limits of sensing means 38, one or the other of rollers 32, 34 is caused to descend from a clearance position and bear on the surface of fabric 48. Rollers 32, 34 are shown mounted at exaggerated angles 56, 58 respectively, relative to stitch line 60. As fabric 48 is urged in the direction of arrow 54 by feed dogs 50, edge 46 may be too far to the left to provide the uniform seam width 36 and, under this condition, the roller 32 will be caused to engage fabric 48 and displace the edge 46 an adjusting distance to the right. Once edge 46 is returned to within the limits of sensing means 38, roller 32 becomes disengaged. If the opposite happens, namely where edge 46 is sensed to be moving too far to the right, it will be roller 34 that will be caused to bear on fabric 48 and thereby move the fabric laterally to the left so as to again be within the limits of sensing means 38, after which roller 34 will disengage.

In contrast to the just described prior art seam width control, reference should be made to FIGS. 3–8 which illustrate the present invention in detail. Like the machine 10 in FIG. 1, sewing machine 56 is built according to standard practice and has a sewing station or position 58, at which fabric is held in position by presser foot 60 and is incrementally urged rearwardly in the sewing direction denoted by arrow 62, along machine table 64 by feed dogs 66. Adjustably mounted on, but which also can be recessed within, table 64 is a pair of photoelectric cells 68 and 70 that are responsive to light 72.

A tread assembly 74 and associated equipment are mounted on the left end and rear of machine 56, as best shown in FIG. 3. Variable speed drive means 76 shown in FIG. 3 (and better in FIG. 4) is connected by shaft 78 and by opposite end universal joints 80 to tread assembly 74 via a drive shaft 82. Support shaft 84 is clamped in bracket block 86 and adjustably suspends the tread assembly 74 in sliding contact with machine table 64.

To the rear of shaft 84 (FIGS. 5 and 6) are provided electrical or mechanical means 88 to vertically pivot the distal end of tread assembly 74 away from machine table 64 by a small angle 90 to thereby facilitate placing fabric to be sewn beneath assembly 74. Means 88 may be activated independently or in simultaneous cooperation with presser foot 60 when fabric is to be loaded or removed, into or from sewing position 58.

On the lower end of shaft 84, a yoke block 92 supports tread assembly chassis members 94. That is, chassis members 94 form a housing within which is located a drive sprocket 96 and a follower sprocket 98, both suitably arranged to guide and support a closed loop endless belt 100. In a well understood manner, drive means 76, linkage 78, 80 and drive shaft 82 are all coordinated to move the lower length 102 of endless belt 100 in the same direction 62 as the fabric that is being fed by presser foot 60 and feed dogs 66 during the sewing operation.

Figure 7:
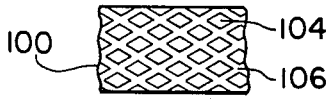
FIG. 7 is a detailed view of the surface of a belt of the FIG. 4 device, as taken along line 7—7 of FIG. 5.
Figure 8:
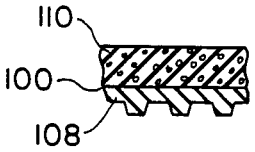
FIG. 8 is a sectional view taken along line 8—8 of FIG. 4.

For favorable fabric gripping, endless belt 100 (as best shown in FIGS. 7 and 8) has a foam rubber body portion 110 with a textured surface of lands 104 and valleys 106. In a preferred embodiment foam body portion 110 is bonded to timing belt 108 and it is the flexibility of the foam body portion 110 which allows for variations in fabric thickness. Sprocket 96 is spaced above table 64 the minimal distance sufficient to allow belt 100 to engage with fabric 112 passing thereunder, the textured surface of the belt allowing such grip to be accomplished without need to vertically adjust the position of the belt upon engagement. Means 88 may be activated in a periodic manner during fabric travel to pivot pulley sprocket 98 up and down about the axis of drive shaft 82 to further facilitate continuous entry of the fabric between the belt 100 and table 64.

As it was earlier explained, it is when an operator is sewing that it typically becomes necessary to move fabric 112 laterally to the left or right in anticipation of a change in the shape of fabric edge 114 in order to maintain a constant seam edge distance 116, a situation depicted in FIGS. 9–12. The within inventive method to this end contemplates use of a photoelectric cell system. The same electrical circuit will be understood to provide the operational mode required of the photoelectric cells 68 and 70, as well as operate the variable speed drive 76 of the belt 74, and being conventional, is not shown or described herein as being unnecessary for an understanding of the invention. The aforementioned Andersson '718 patent discloses analogous photocell-based circuitry used to drive roller means; such circuitry may be easily adapted by one skilled in the art to vary the belt speed as required herein.

The rate at which fabric 112 moves past sewing position 58, or is "sewn", varies with the skill of the operator, the material used, the stitch size, the complexity of the article being sewn, and other such factors. As sewing takes place, it is the function of the endless belt 100 to move the fabric 112 from its adjacent location to the sewing position 58 optionally either (a) at the same rate as, (b) a little slower than, or (c) a little faster than, the speed that the fabric 112 is urged through sewing position 58 by feed dogs 66. Stated another way, the relative rate of speed of the belt 100 can adjustably be equal to, less than or greater than, the rate of speed of fabric 112 at sewing position 58 as determined by the controlling photocell array. This adjustable relative belt speed provides a uniform seam width on a changing curved fabric edge, all as now will be explained in detail.

Figure 9:
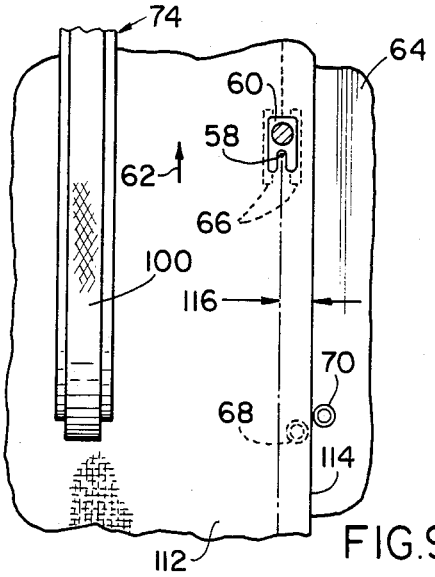
FIGS. 9–12 are similar detail plan views of the sewing station and fabric being sewn thereat, in which are illustrated the variety of sewing conditions typically encountered.

In FIG. 9 is shown a common situation where edge 114 is straight and falls between cells 68 and 70. This sewing condition would call for a straight line movement of fabric in the direction of arrow 62; therefore, the rate of fabric movement past sewing position 58 would be the same as the drive speed of belt 100. This satisfies the condition a), above noted.

Figure 10:
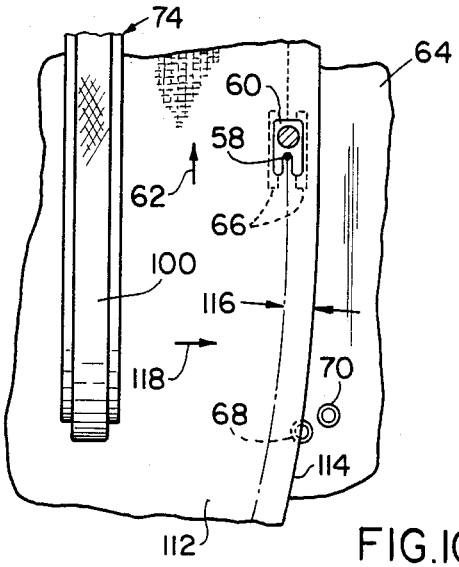

Condition b) is shown in FIG. 10, wherein the entering fabric edge 114 is curved to the left. To maintain distance 116 it will be necessary to move fabric 112 to the right (arrow 118) about sewing position 58. It is to be noted that photocell 68 is partly uncovered and will, therefore, receive illumination from lamp 72. The illumination from lamp 72 is effective to produce an electrical signal that will cause the speed of belt 100 to slow down proportionately compared with the fabric rate past the sewing position 58. This slow down, while the feed dogs 60 maintain speed, should be readily appreciated as providing the fabric position shift in the direction 118 to the right, since the belt length contact along 102 with the fabric is a "drag" on fabric movement while the faster feed dog movement pulls thereon, and the fabric, thus, responds by moving to the right.

Figure 11:
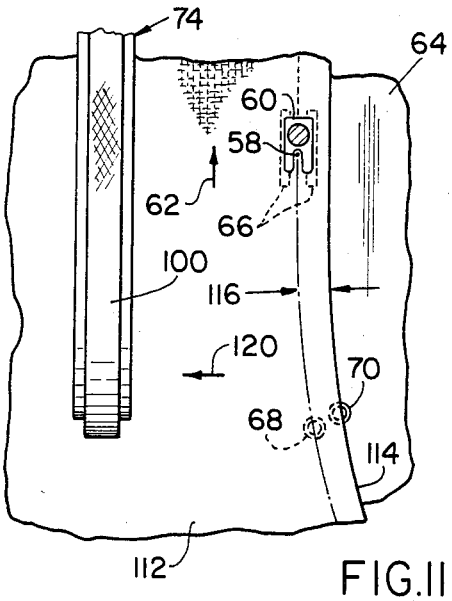

When entering fabric edge 114 curves to the right as shown in FIG. 11, condition c) will be present. In this situation, photocell 70 now becomes partially covered in conjunction with covered cell 68, and this signal will cause the speed of belt 100 to increase proportionately. This action results in a clockwise movement (arrow 120) of fabric 112 about sewing position 58, since the feed dogs 66 are now the "drag" and the belt 100 now "pulls", and the fabric responds by shifting in the direction 120.

Figure 12:
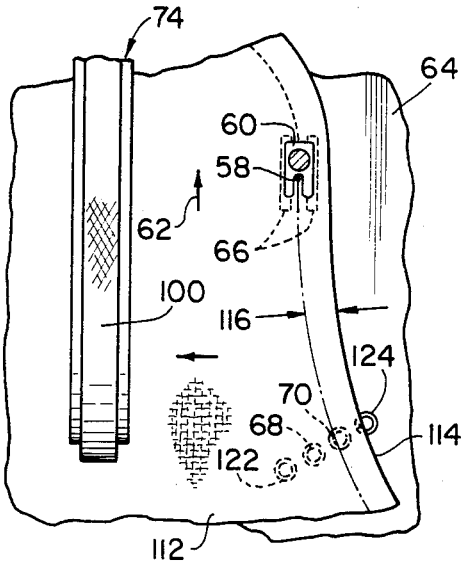

FIGS. 10 and 11 depict situations where gentle "flat" curves are to be dealt with. A more severe case as exemplified FIG. 12, may also be encountered where fabric edge 114 changes shape rapidly and to deal with this there are provided multiple pairs of photocells such as 122 and 124 which may be installed to regulate more than one range of speed for belt 100. In FIG. 12, cell 70 is shown covered by fabric 112 indicating that belt 100 is not moving fast enough to move fabric 112 to the left and cell 124 is beginning to be covered by edge 114. This second stage signal from cell 124 would then cause the belt 100 to increase speed further in cooperation with suitable circuitry and drive means 76. Thus, it is within the scope of the invention to provide multiple controls in cooperation with as many response devices as is necessary to facilitate control over more complex sewing patterns than those of FIGS. 9–11.

While the particular sewing machine seam width control apparatus and method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In a combination fabric guiding attachment and a sewing machine of the type in which said sewing machine has a flat support for fabric being sewn and feed dogs for urging said fabric in sewing relation to said sewing machine in a feed path along said flat support and wherein said fabric guiding attachment is in an offset relation to said feed path and is operatively effective in response to photo electric cells to additionally move said fabric during its said travel along said feed path also in directions lateral thereto to enable the sewing of changing curvatures in the edge of said fabric, the improvement in said combination fabric guiding attachment and sewing machine consisting of said offset fabric guiding attachment being comprised of a pulley belt entrained about pulley sprockets and oriented in the direction of said sewing feed path so as to be parallel thereto, at least one said pulley sprocket being spaced at an optimum minimum clearance position above said flat support so as to establish contact of said pulley belt entrained thereabout with said flat support so as to obviate the need of any descending movement in said pulley belt incident to the use thereof in imparting shifting movement in said fabric, and speed control means operatively connected to control independently of each other the speed at which said feed dogs urge said fabric along said feed path and the speed at which said pulley belt urges said fabric along said feed path, whereby differences in the aforesaid speeds causes lateral direction shifting in said fabric during its travel along said feed path to enable the sewing of changing curvatures in the edge of said fabric.

2. The improvement in said combination fabric guiding attachment and sewing machine as claimed in claim 1 wherein the pulley sprocket providing said established contact of said pulley belt with said flat support is rearwardly disposed along said feed path, and wherein another of said pulley sprockets is forwardly disposed along said feed path and is operatively arranged to be urged through ascending and descending movements in relation to said flat surface, to thereby facilitate the engagement and release of said fabric by said pulley belt.

3. The improvement in said combination fabric guiding attachment and sewing machine as claimed in claim 2 wherein the construction material of said pulley belt is elastomeric and of a selected thickness so as to allow for different thicknesses of fabric being sewn.

* * * * *